US005311886A

United States Patent [19]

De Grandpré et al.

[11] Patent Number: 5,311,886

[45] Date of Patent: May 17, 1994

[54] TOBACCO EXTRACT TREATMENT WITH INSOLUBLE ADSORBENT

[75] Inventors: Yves D. De Grandpré, Boucherville; Andrew R. Porter, Montreal, both of Canada

[73] Assignee: Imasco Limited, Canada

[21] Appl. No.: 816,520

[22] Filed: Dec. 31, 1991

[51] Int. Cl.[5] ..... A24B 15/20; A24B 15/24

[52] U.S. Cl. ..... 131/297; 131/308; 131/309

[58] Field of Search ..... 131/297, 308, 309

[56] References Cited

U.S. PATENT DOCUMENTS

| | | | |
|---|---|---|---|
| 2,108,860 | 2/1938 | Kauffman | 131/140 |
| 3,557,023 | 1/1971 | Raible | 252/450 |
| 3,840,026 | 10/1974 | Rosen | 131/297 |
| 4,200,113 | 4/1980 | Schmidt | 131/17 |
| 4,887,618 | 12/1989 | Bernasek et al. | 131/297 |

FOREIGN PATENT DOCUMENTS

| | | | |
|---|---|---|---|
| 0408175A2 | 1/1991 | European Pat. Off. | A24B 15/24 |
| 1015764 | 9/1967 | Fed. Rep. of Germany . | |
| 2314677 | 1/1977 | France | A24B 15/02 |

OTHER PUBLICATIONS

Abstract No. 76-49075X, Derwent Publications, Ltd., London, (May 15, 1976).

Abstract No. 79-36246B, Derwent Publications, Ltd., London, (Apr. 4, 1979).

Abstract No. 74670q, *Chemical Abstracts*, vol. 92, No. 9 (Mar. 1980).

Search Report filed Apr. 1, 1993 PCT/EPO.

Patent Abstracts of Japan, vol. 012, No. 387 (C-536) Oct. 14, 1988, and JP,A,63132898 (Meito Sangyo KK) Jun. 4, 1988.

Database WPIL, Derwent Publications Ltd., London, GB; AN 83-820786 and AU,D,1298383 (Misconi) Oct. 6, 1983.

*Primary Examiner*—Vincent Millin
*Assistant Examiner*—William M. Pierce
*Attorney, Agent, or Firm*—Townsend and Townsend Khourie and Crew

[57] ABSTRACT

This invention provides a method for reducing the protein content of tobacco material which includes extracting the tobacco material with a solution containing a surfactant. The tobacco material may be first extracted with an aqueous solvent to produce an aqueous extract before being treated with the solution containing a surfactant. This invention also provides a method for removing polypeptides from an aqueous extract of tobacco material which includes treating the extract with an insoluble adsorbent selected from the group comprising hydroxyapatite and a fuller's earth mineral such as bentonite. Treatment of the aqueous extract with bentonite will produce an extract having a reduced pigment and polypeptide content.

11 Claims, 1 Drawing Sheet

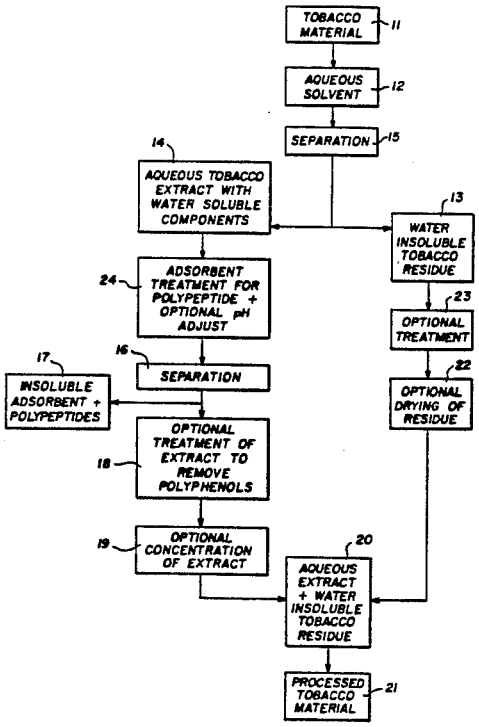

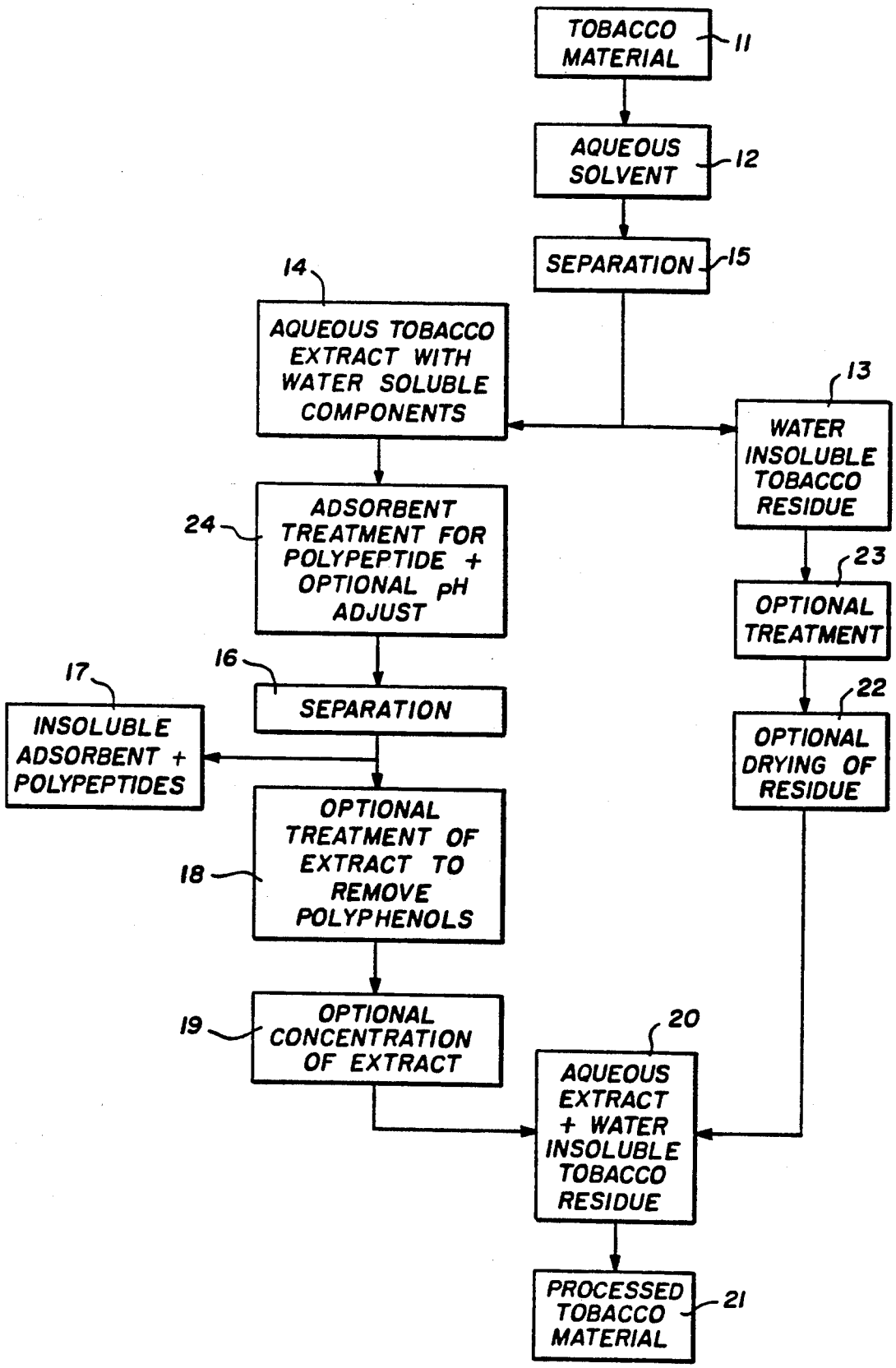
TOBACCO MATERIAL
11
AQUEOUS SOLVENT
12
SEPARATION
15
14
AQUEOUS TOBACCO EXTRACT WITH WATER SOLUBLE COMPONENTS
13
WATER INSOLUBLE TOBACCO RESIDUE
24
ADSORBENT TREATMENT FOR POLYPEPTIDE + OPTIONAL pH ADJUST
23
OPTIONAL TREATMENT
16
SEPARATION
17
INSOLUBLE ADSORBENT + POLYPEPTIDES
22
OPTIONAL DRYING OF RESIDUE
OPTIONAL TREATMENT OF EXTRACT TO REMOVE POLYPHENOLS
18
19
OPTIONAL CONCENTRATION OF EXTRACT
20
AQUEOUS EXTRACT + WATER INSOLUBLE TOBACCO RESIDUE
PROCESSED TOBACCO MATERIAL
21

TOBACCO EXTRACT TREATMENT WITH INSOLUBLE ADSORBENT

BACKGROUND OF THE INVENTION

Several investigators have found that tobacco quality is improved by reducing its protein content. Although it is relatively easy to remove protein from uncured tobacco leaf, there are disadvantages to removing protein before curing. The major problem is that protein broken down during curing can form flavour compounds that are important contributors to the organoleptic properties of the smoke. Another disadvantage is that efficient extraction of green leaf usually necessitates tobacco structural changes which make it difficult to produce shredded tobacco suitable for use as a cigarette filler.

Partial removal of protein from cured tobacco can be accomplished by extraction with water, with the efficiency of the extraction improving as the particle size is reduced. However, for shredded tobacco of the size normally used for cigarette manufacture, most of the protein cannot be extracted by water alone. Several inventors have found that proteolytic enzymes will break down tobacco protein into readily soluble fragments and that strip or cut tobacco can be treated by such enzymes. Thus Gaisch et al. (U.S. Pat. No. 4,407,307) described the removal of protein from tobacco strips in an aqueous solution of a proteolytic enzyme whereby insoluble proteins are decomposed into soluble fragments. The extract is separated from the tobacco and inoculated with a yeast culture, which, as it grows, removes the soluble protein fragments in the extract by metabolic assimilation. After removal of the yeast, the protein-free extract is concentrated and added back to the tobacco strips. Bernasek et al. (U.S. Pat. No. 4,887,618) describe a process in which tobacco is first extracted with water. The tobacco residue remaining after extraction is separated from the solution, mixed with water and treated with a proteolytic enzyme. The protein-reduced tobacco is separated from the enzyme solution, rinsed and dried. The water extract is concentrated and added back to the protein reduced tobacco. The advantage described by Bernasek et al. for this process is that the water soluble flavour components of tobacco and the nicotine can be retained in the final product.

The above described processes rely on protease enzymes alone to remove protein from tobacco material. Our own investigations have found that enzymes which efficiently remove protein from tobacco are expensive, while those enzymes which are available in commercial quantities at a reasonable price, are much less efficient for protein removal. Poulose et al. (U.S. Pat. No. 4,716,911) has also realized this disadvantage and proposed using either an alkali or a combination of a protease and a non-protease depolymerase to effect protein removal in an overall processing scheme similar to that of Gaisch et al. However, we have found that alkaline solutions at the strengths quoted by Poulose et al. may have a deleterious effect on the physical structure of the tobacco. Moreover, the use of a protease combined with a depolymerase may not be an economical approach to protein removal.

It is desirable to provide a technique for protein removal from tobacco material which does not cause a physical dègradation of the tobacco structure and is economical and efficient. Tobacco material includes tobacco solids and any solid form of tobacco including cured tobacco.

It is also desirable to provide an efficient and cost effective process for removal of solubilized polypeptides (which include proteins) from an aqueous extract of tobacco, before the extract is added back to tobacco material. In the aforementioned patent of Gaisch et al., this was accomplished by assimilation of protein fragments by yeast. Clapp et al. (U.S. Pat. No. 4,941,484) describes the use of ultrafiltration to remove high molecular weight compounds (e.g. proteins) from an aqueous extract of tobacco before the extract is added back to protein-reduced tobacco. The process of Gaisch et al. is complicated by the requirement to ferment the aqueous extract in the presence of yeast. .The ultrafiltration process of Clapp et al. requires the use of ultrafiltration apparatus and may not be useful for the removal of proteins or polypeptides outside the cut-off values of the ultrafiltration membrane employed in the procedure.

It is also known to treat aqueous extracts of tobacco with solid adsorbents which will remove polyphenols from the extract according to the patent of Jacin, et al. (U.S. Pat. No. 3,561,451). Such adsorbents include alumina and polyamide which are not useful for removal of solubilized protein or polypeptides from the aqueous extract. Heretofore, there were no adsorbents known to be useful for removal of the polypeptides found in a tobacco extract in commercial batch processing.

SUMMARY OF THE INVENTION

This invention provides methods which involve the extraction of tobacco material with surfactants either used alone or in combination with a proteolytic enzyme. In the latter instance it is possible to use less surfactant and protein extraction is more efficient than with enzyme treatment alone or with surfactant treatment alone.

This invention also provides methods that involve the use of hydroxyapatite and fuller's earth minerals such as bentonite as insoluble adsorbents for removal of polypeptides from aqueous extracts of tobacco. Bentonite is a particularly effective adsorbent because, of its low cost and effectiveness in small quantities. This is surprising since bentonite is known to be useful for absorbing proteins in acidic beverages such as beer and wine but would not be expected to be effective for removal of proteins from more basic solutions such as a tobacco extract. Furthermore, it is also known that bentonite will adsorb nicotine, which may not be desirable in a tobacco treatment. Surprisingly, bentonite may be used to selectively adsorb polypeptides rather than nicotine. Bentonite is also effective for removal of pigment compounds from an aqueous extract of tobacco which is often advantageous because such compounds tend to darken tobacco material when the extract is applied to the material, particularly if the extract has been heated (for example, to facilitate concentration of the extract).

Accordingly this invention provides a method for reducing the protein content of tobacco material which includes extracting the tobacco material with a solution containing a substance selected from the group comprising a surfactant and a surfactant combined with a proteolytic enzyme. This invention also provides the preceding method wherein the tobacco material to be extracted with the solution has been previously extracted with an aqueous solvent to produce an aqueous extract.

This invention also provides a method for removing polypeptides from an aqueous extract of tobacco material which includes combining the extract with an insoluble adsorbent selected from the group comprising hydroxy-apatite and a fuller's earth mineral and, separating the extract from the adsorbent.

This invention also provides tobacco material and tobacco extracts produced according to the above described methods, including an aqueous extract of tobacco material having a reduced pigment and polypeptide content.

In one aspect of this invention, the tobacco is extracted directly with an aqueous solution of a surfactant or a mixture of a surfactant with a proteolytic enzyme. The extract is separated from the tobacco residue and treated in various ways to remove surfactant, protein and/or protein fragments. The treated extract is concentrated and added back to the protein reduced tobacco.

In another aspect of this invention, the tobacco is first extracted with an aqueous solvent. The extract is separated from the insoluble tobacco residue and retained for subsequent reconstitution. The extract may be treated to remove solubilized proteins (polypeptides) as described below. The tobacco residue is resuspended in an aqueous solution of a surfactant or a mixture of surfactant and proteolytic enzyme. After further protein has been solubilized in this mixture, the solution is discarded and the extracted tobacco residue is rinsed and dried. The aqueous extract from the initial extraction is preferably concentrated and sprayed back onto the tobacco to make a smokable cigarette filler. This embodiment is preferred since it is easier to ensure complete removal of surfactant and enzyme from the final tobacco product.

The tobacco extracts described above can optionally be treated to remove soluble materials to further enhance tobacco quality. For example, we have found that the extract can be treated with polyvinylpolypyrrolidone (PVPP) as an insoluble adsorbent for effective removal of polyphenols from the solution. The extracts may be treated with hydroxyapatite or a fuller's earth mineral to remove solubilized polypeptides, and in the case of bentonite treatment, to also remove pigment compounds. In each case, the extract may be combined with the adsorbent by simply suspending the adsorbent in the solution and then removing the adsorbent by conventional means such as filtration or centrifugation. There are other ways of combining the extracts or solutions with an insoluble adsorbent that are well known and may be used in the method of this invention. For example, the adsorbent may be contained in a column or other suitable container and the extract is allowed to flow through the column or container to permit adsorption to occur.

It will be apparent that the methods of this invention may be combined with known methods for treating tobacco to obtain the advantages of this invention.

BRIEF DESCRIPTION OF THE DRAWING

The drawing attached hereto is a flow diagram of a process for treating tobacco in accordance with the present invention.

DETAILED DESCRIPTION OF THE INVENTION

In one embodiment of this invention, strip, cut or ground tobacco 11, and preferably cut tobacco, is extracted at 35°-65° C. in an aqueous solution 12 of a surfactant or a mixture of surfactant and proteolytic enzyme. The solvent, which is usually water, but can also contain alcohols such as ethanol or methanol, is added to the tobacco material in the ratio of between 10:1 and 30:1 by weight. The surfactant may be selected from the group including the sodium alkylsulfonates, sodium alkylsulfates, the sodium or potassium salts of carboxylic acids, sodium alkylarylsulfonates and sodium alkylsulfosuccinates. For these surfactants, the most effective have a chain length of between 8 and 12 carbon atoms. Particularly effective surfactants are sodium dodecylsulfate, sodium dodecylbenzenesulfonate and sodium dioctylsulfosuccinate (Aerosol OT*). Cationic and non-ionic surfactants may be used but these have been found to be less effective than the anionic surfactants. The surfactant is added to the solvent in the concentration range 0.1%-5% w/v solution. The proteolytic enzyme, if used, is chosen from the group comprising the bacterial and fungal enzymes. Of most interest for the purpose of this invention are the enzymes used commercially in the food and detergent industries which are available at low cost. Thus Savinase*, Neutrase*, Enzobake* or Alcalase* available from Novo Inc. have been found to be effective for protein removal from tobacco. The proteolytic enzymes are added to the solution in the concentration range 0.1%-5% w/w of the tobacco material.

*Trade-mark

The suspension of tobacco material in the solution of surfactant and proteolytic enzyme is stirred gently for 1-18 hours. The extracted tobacco 13 is separated from the solubilized tobacco 14 components by filtration or centrifugation 15. Up to about 65% of the initial tobacco weight may be solubilized during this extraction step. The tobacco components that go into solution are nicotine, sugars, proteins and/or polypeptides and amino acids, pectins, polyphenols, flavours, inorganic salts, etc.

The extract 14 may be treated in a number of ways to remove surfactant and polypeptides 17, or other components, before the extract is added back in concentrated form to the extracted tobacco.

The surfactant may be removed by using either of the following treatments or preferably both in sequence. The solution is cooled to below the Krafft temperature of the surfactant at which temperature, up to 50-70% of the surfactant precipitates. Cooling the solution to 4° C. is effective. Remaining surfactant is precipitated using an inorganic calcium or magnesium salt. The precipitated surfactant and/or its insoluble calcium or magnesium salts may be removed from the solution by filtration or centrifugation.

Protein (polypeptides) 17 may be removed from the solution 14 using an insoluble adsorbent 24 as hydroxyapatite, or one of the fuller's earth minerals such as attapulgite or bentonite. Larger amounts of adsorbent remove greater amounts of protein. When hydroxyapatite is added in a quantity of about 16-25% of the initial tobacco weight (the weight of the tobacco used to provide the extract) up to about 50% of the dissolved protein is removed. When about 10% of the initial tobacco weight of attapulgite is used, all or a large proportion of the dissolved protein is removed.

Bentonite is also an effective adsorbent for polypeptides. When bentonite is added to the tobacco extract in a quantity that is about 3-4% of the weight of the tobacco extracted, a large proportion of the protein nitrogen is removed from solution. Some nicotine is also adsorbed from solution, but this loss is minimal at the concentrations of bentonite required to remove most of the protein. The quantity of bentonite may be reduced if the bentonite is slurried in a small quantity of water before adding it to the tobacco extract. Pre-mixing with water swells the bentonite, which forms a flocculent suspension when added to the tobacco extract. Bentonite treatment is also effective in removing pigment compounds found in a tobacco extract which, if not removed, tend to darken the extract after concentration, particularly if the extract is heated.

In the case of bentonite, it appears that a tobacco extract is an effective buffer against the adsorbent's tendency to make a solution more alkaline. Although it is generally unnecessary in the methods of this invention to adjust the pH of the tobacco extract, the efficiency of adsorption by bentonite may be increased by reducing the pH of the extract. Flue-cured tobacco extracts typically have a pH in the range 5-6. As the pH is lowered by adding an acid, smaller quantities of bentonite may be required for polypeptide and pigment removal. The optimum pH is about 3. The pH may be adjusted by addition of any suitable acid such as hydrochloric.

At this stage, other components of the extract may also be selectively removed. For example PVPP may be used as an insoluble adsorbent 18 using the same methods as for absorption of polyphenol. PVPP in an amount representing 5-10% of the initial tobacco weight removes up to about 50-90% of the polyphenols in solution.

Preferably the extract is concentrated 19 to a solids concentration of between 20-50% by weight. Concentrations of between 20-30% are most efficiently achieved using reverse osmosis, using procedures known in the art such as that disclosed by Molyneux (U.S. Pat. No. 3,847,163). However, other methods of concentration, particularly those which preserve the flavour and other components of the extract are known and can be used.

The extracted tobacco 13, if in the cut or strip form, may be dried 22 by a variety of known methods. Also, a rotary dryer with steel combs attached to the inside wall of the drum to prevent balling of the wet tobacco may be used to dry the tobacco.

The concentrated extract may be sprayed 20 onto the tobacco, for example during or after drying. This results in a tobacco 21 which is very similar in physical form and appearance and smoking properties to the original material, but with substantially reduced levels of protein. When sufficient bentonite is used as an adsorbent, the consequent removal of pigment compounds results in a product that is not overly darkened by the addition of the concentrated extract.

If the original tobacco is in the ground form, the final product may be cast into a sheet, which, when shredded, can form all or part of a cigarette filler.

In another embodiment of the invention, the tobacco 11 is first extracted with an aqueous solvent 12 consisting either of water or a mixture of water with an alcohol (for example, methanol or ethanol). The ratio of solvent to tobacco is preferably about 20:1 by weight but can be as low as 12:1. The extraction time may be between fifteen minutes and one hour at a temperature between 15-60° C. The preferred conditions are ½ hour at 25° C. This extraction step results in some of the protein and most of the sugars, nicotine, amino acids, polyphenols, etc. being removed from the tobacco into solution. The aqueous extract may be separated 15 from the tobacco by filtration or centrifugation.

Polypeptides, polyphenol 18, and pigment compounds etc. can be removed from this extract 14 by the methods described in the first embodiment. The extract may be concentrated by reverse osmosis or by other known methods.

The extracted tobacco is subjected to a further extraction step 23 to remove protein. An aqueous solution of a surfactant such as described in the first embodiment, at a concentration in the range 0.01-5% (w/v) is added to the wet or dried tobacco residue in the ratio of 20:1 to 30:1 (solution: dry tobacco weight). Alternatively, a proteolytic enzyme such as described in the first embodiment, may be added to the surfactant solution in the concentration range of 0.1-5%. If surfactant alone is used, the tobacco slurry is agitated gently for 1-18 hours at 24°-65° C. For a mixture of surfactant and enzyme, the same time may be allowed for the extraction but a narrower temperature range such as 30°-40° C. should be used to avoid denaturing the enzyme.

Following extraction, the tobacco may be separated from the solution by filtration or centrifugation and rinsed thoroughly with water. The tobacco residue may then be dried and the concentrated extract sprayed back onto the tobacco material, as described in the first embodiment.

EXAMPLE 1

Two hundred and fifty grams (250 g) of a single grade of flue-cured tobacco, cut at 35 cpi, was extracted with 5 liters of water containing 100 g of sodium dodecylsulphate (SDS). The extraction was carried out for 18 hours at 60°-70° C. with gentle stirring. The tobacco was separated from the solution by filtration and dried using a small rotary drier. After correction for moisture content, it was calculated that 66% of the tobacco weight was in the solute. The initial nitrogen content of the tobacco, as determined by the Kjeldahl method, was 1.82% (on a dry weight basis) while the extracted tobacco had a nitrogen content of 0.94% (on a dry weight basis). Thus 82% of the nitrogen in the tobacco was solubilized.

The extract was cooled to 4° C. and the precipitated SDS collected by filtration. This resulted in recovery of 68% of the SDS. The remaining SDS was precipitated by adding 6 g of $CaCl_2$ to the solution. The precipitate was removed by filtration.

Fifty grams (50 g) of hydroxyapatite was added to the solution, stirred for ½ hour, and removed by filtration. The protein content of the solution was measured before and after treatment by the BioRad* method. Hydroxyapatite reduced protein content by about 50%.

*Trade-mark

The extract was allowed to evaporate at 25° C. until it was sufficiently concentrated to spray back onto the treated tobacco.

EXAMPLE 2

Five hundred grams (500 g) of a single grade of flue-cured tobacco, cut at 35 cpi. was extracted with 10 liters of water for 18 hours at 60°-70° C.

The tobacco was separated from the solution by filtration and thoroughly rinsed with warm water. The water extracted tobacco residue was dried to 13% moisture in a rotary drier.

The water extracted tobacco residue was divided into 20 g portions and each was re-extracted at 60°–70° C. for 18 hours in 600 ml of a solution containing 0–15 g of sodium dodecylbenzenesulfonate. The surfactant treated tobacco was filtered, thoroughly rinsed with water and dried. The dried residues were analyzed for nitrogen using the Kjeldahl method. The results for Kjeldahl nitrogen of the extracted tobacco at different surfactant concentrations are given in Table I.

TABLE I

| SDBS concentration (g/l) | Kjeldahl Nitrogen % |
|---|---|
| 0.0 | 2.03 |
| 0.83 | 2.03 |
| 2.5 | 1.93 |
| 5.0 | 1.87 |
| 10.0 | 1.67 |
| 15.0 | 1.74 |
| 20.0 | 1.60 |
| 25.0 | 1.33 |

EXAMPLE 3

Ten gram (10 g) portions of water extracted tobacco residue such as was procured in example 2 were dispersed in a solution containing 300 ml of water, 0.25 g of Savinase* (NOVO Industri, Denmark) with an activity of 6.0 KNPU/g and various amounts of sodium dodecylbenzenesulfonate. The slurries were gently stirred for 18 hours at room temperature. The tobacco residues were filtered from the slurry, thoroughly rinsed with water and dried in a rotary dryer. The results for Kjeldahl nitrogen determinations on the tobacco residues are given in table II.

*Trade-mark

TABLE II

| SDBS (g) | Savinase (g) | Kjeldahl Nitrogen % |
|---|---|---|
| 0 | 0 | 2.57 |
| 0 | 0.25 | 1.79 |
| 6.0 | 0 | 1.81 |
| 0.75 | 0.25 | 1.90 |
| 1.50 | 0.25 | 1.62 |
| 3.00 | 0.25 | 1.26 |
| 4.50 | 0.25 | 1.17 |
| 6.00 | 0.25 | 1.29 |
| 7.50 | 0.25 | 1.30 |
| 9.00 | 0.25 | 1.35 |

EXAMPLE 4

300 g of flue-cured shredded tobacco was extracted with 6 liters of water for 1 hour at 30° C. The tobacco extract was separated from the tobacco by centrifugation and divided into 200 ml aliquots, which were treated with various quantities of either hydroxyapatite or bentonite. The adsorbents were added as dry powders to the extracts and the resulting suspensions were shaken for 15 minutes. The extracts were filtered and protein nitrogen determined by the Bio Rad* method. Kjeldahl nitrogen, nicotine and total sugars were determined for freeze dried samples of the extract. The results are given in Table III. The presence of pigment compounds in the extract was noticeably reduced when the amount of bentonite used was equivalent to 4%, or more, of the weight of the tobacco used to provide the extract.

Trade-mark

Various changes and modifications may be made in practicing this invention without departing from the spirit and scope thereof.

TABLE III

| Sugars | Absorbent Concentration (mg/ml) | Absorbent Concentration (as % Tob. wt.) | Protein Nitrogen (Control = 100) | Kjeldahl Nitrogen (%) | Nicotine (%) | Total Sugars (%) |
|---|---|---|---|---|---|---|
| Hydroxyapatite | 0 | (0) | 100 | 2.29 | 4.21 | 36.7 |
| | 8 | (16) | 52 | 2.21 | 4.26 | 37.0 |
| | 24 | (48) | 57 | 2.17 | 4.26 | 37.2 |
| | 60 | (120) | 14 | 2.29 | 4.28 | 37.3 |
| Bentonite | 0 | (0) | 100 | 2.33 | 4.20 | 38.1 |
| | 0.5 | (1) | 12 | 2.35 | 4.17 | |
| | 1.0 | (2) | 20 | 2.26 | 4.06 | |
| | 1.5 | (3) | 16 | 2.33 | 3.95 | |
| | 2.0 | (4) | 3 | 2.27 | 3.83 | |
| | 2.5 | (5) | 1 | 2.21 | 3.53 | |
| | 4.0 | (8) | 5 | 1.97 | 3.21 | |
| | 5.0 | (10) | 3 | 1.83 | 2.92 | 39.5 |
| | 7.5 | (15) | 0 | 1.94 | 2.23 | |
| | 10.0 | (20) | 0 | 1.61 | 1.62 | |
| | 20.0 | (40) | 3 | 1.37 | 0.54 | 40.2 |

We claim:

1. A method for removal of polypeptides from an aqueous tobacco extract solution, which method comprises the steps of:
   (a) mixing the solution together with an insoluble absorbent selected from the group consisting of hydroxylapatite, bentonite, and fuller's earth mineral; and
   (b) separating the extract from the absorbent.

2. The method of claim 1 wherein the absorbent is bentonite.

3. The method of claim 2 wherein the amount of bentonite is at least 1% of the weight of the tobacco used to provide the extract and the bentonite is suspended in the solution.

4. The method of claim 3 wherein the tobacco used to provide the extract is flue-cured.

5. The method of claim 3 wherein the amount of bentonite is at least 4% of the weight of the tobacco used to provide the solution.

6. An aqueous solution of tobacco having a substantially reduced pigment and polypeptide content produced according to the method of claim 5.

7. The method of claim 1 wherein the absorbent is hydroxyapatite.

8. The method of claim 7 wherein the hydroxyapatite is suspended in the extract in an amount which is at least 16% of the weight of the tobacco used to provide the solution.

9. The method of claim 8 wherein the tobacco used to provide the extract is flue-cured.

10. The method of claim 1 wherein the absorbent is bentonite and the pH of the solution containing the bentonite is adjusted to about 3.

11. An aqueous solution of tobacco having a reduced polypeptide content produced by the method of claim 1.

* * * * *